United States Patent [19]

Hoening

[11] Patent Number: 4,618,001

[45] Date of Patent: Oct. 21, 1986

[54] SPRINKLER HEAD WITH ELECTRICAL SENSOR

[75] Inventor: Brian T. Hoening, Sellersville, Pa.

[73] Assignee: Central Sprinkler Corporation, Lansdale, Pa.

[21] Appl. No.: 713,529

[22] Filed: Mar. 18, 1985

[51] Int. Cl.[4] ..... A62C 37/18; A62C 37/24

[52] U.S. Cl. ..... 169/23; 169/38

[58] Field of Search ..... 169/23, 90, 37–41

[56] References Cited

U.S. PATENT DOCUMENTS

| | | | |
|---|---|---|---|
| 294,008 | 2/1884 | Buell | 169/39 X |
| 534,631 | 2/1895 | Carpenter | 169/23 |
| 917,292 | 4/1909 | Hankee et al. | 169/37 |
| 3,746,098 | 7/1973 | Grenier | 169/23 X |
| 4,491,182 | 1/1985 | Pieczykolan | 169/38 |

*Primary Examiner*—Jeffrey V. Nase

*Attorney, Agent, or Firm*—Seidel, Gonda, Goldhammer & Abbott

[57] ABSTRACT

A sprinkler head has a flow passage closed by a valve member. The valve member is movable to an open position in response to release of a latch by a temperature sensor. A sensor for sensing a predetermined amount of movement of the valve member towards its open position is provided for generating an electrical signal indicative of such movement.

4 Claims, 5 Drawing Figures

FIG. 1
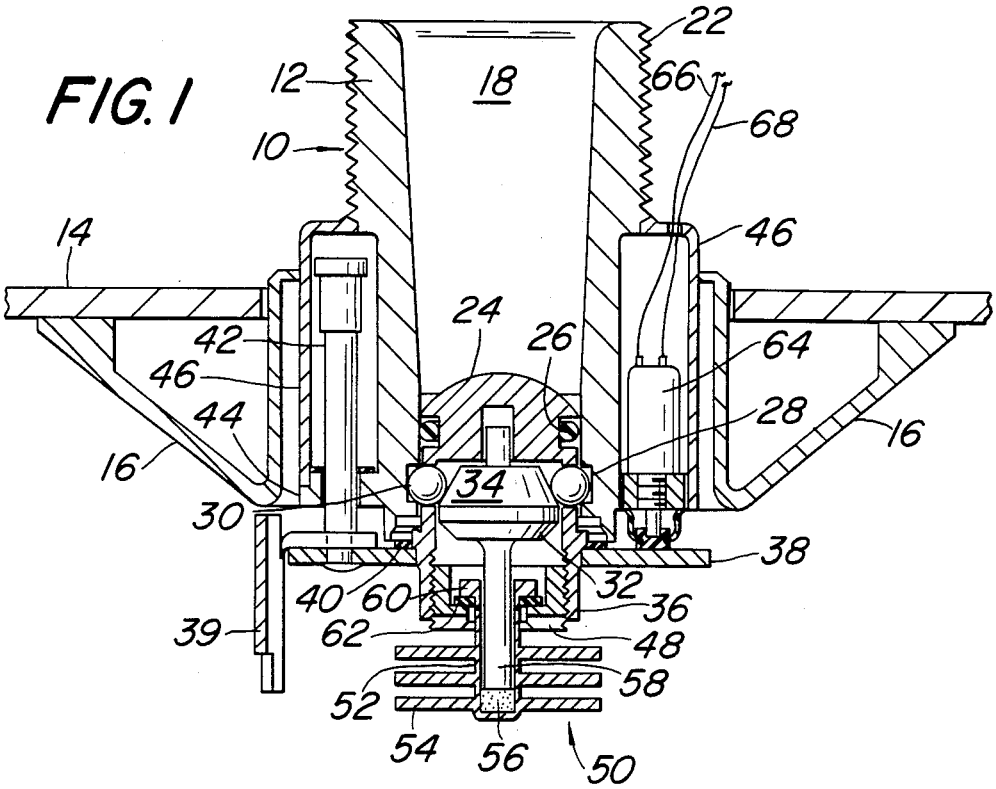
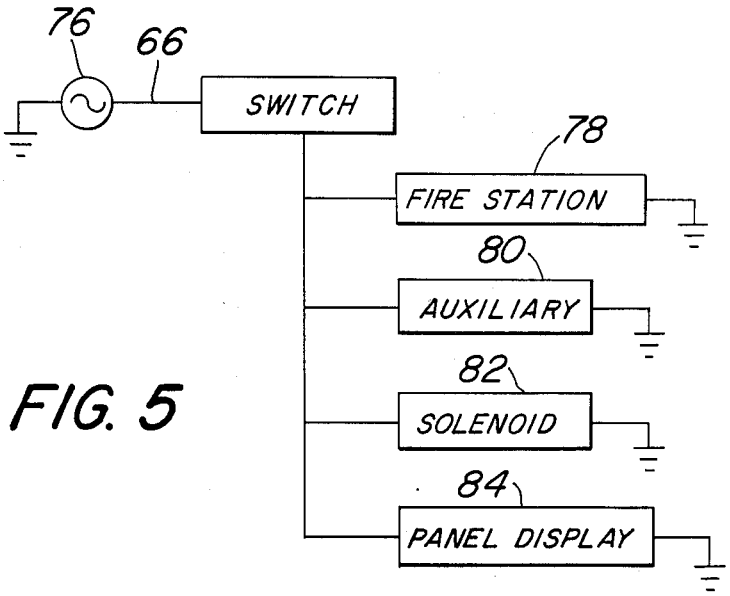
FIG. 5

SPRINKLER HEAD WITH ELECTRICAL SENSOR

BACKGROUND OF THE INVENTION

Known sprinkler heads suffer from a number of problems. For example, if a sprinkler head is tampered with and results in the closure valve moving to an open position, substantial water damage can occur before anyone is aware that the sprinkler head has been tampered with. Another problem with known sprinkler heads is the lack of versatility. In large buildings containing a large number of sprinkler heads, the exact location of a sprinkler head which has been activated due to exposure to a predetermined temperature, is not readily ascertainable at a central location. If a sprinkler head is activated, due to a fire or the like, substantial damage can occur due to air circulating systems in the building.

The present invention is directed to recognition of and solution of the above mentioned problems.

SUMMARY OF THE INVENTION

The present invention is directed to a sprinkler head having a flow passage therethrough. A valve member is provided for closing said passage. The valve member is supported by the housing and is movable to an open position. A latch means is provided on the housing for retaining the valve member in a closed position. A temperature responsive means is provided for releasing the latch at a predetermined temperature. A sensor is provided for sensing a predetermined amount of movement of the valve member towards its open position and providing an electrical signal indicative of such movement.

It is an object of the present invention to provide a sprinkler head which will generate an electrical signal when a valve member has moved a predetermined distance towards its open position regardless of whether such movement was occasioned by tampering, by an accident, or by triggering the temperature responsive control for releasing the latch for the valve member.

It is another object of the present invention to provide a sprinkler head with means for generating an electrical signal capable of activating a local or remote alarm, capable of being indicated on a central control panel, capable of controlling auxiliary equipment such as air circulation systems and closure of doors, and/or capable of opening a solenoid valve in a dry system.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a vertical sectional view of a sprinkler head in accordance with the present invention.

FIG. 5 is a schematic circuit diagram.

DETAILED DESCRIPTION

Figure 2:
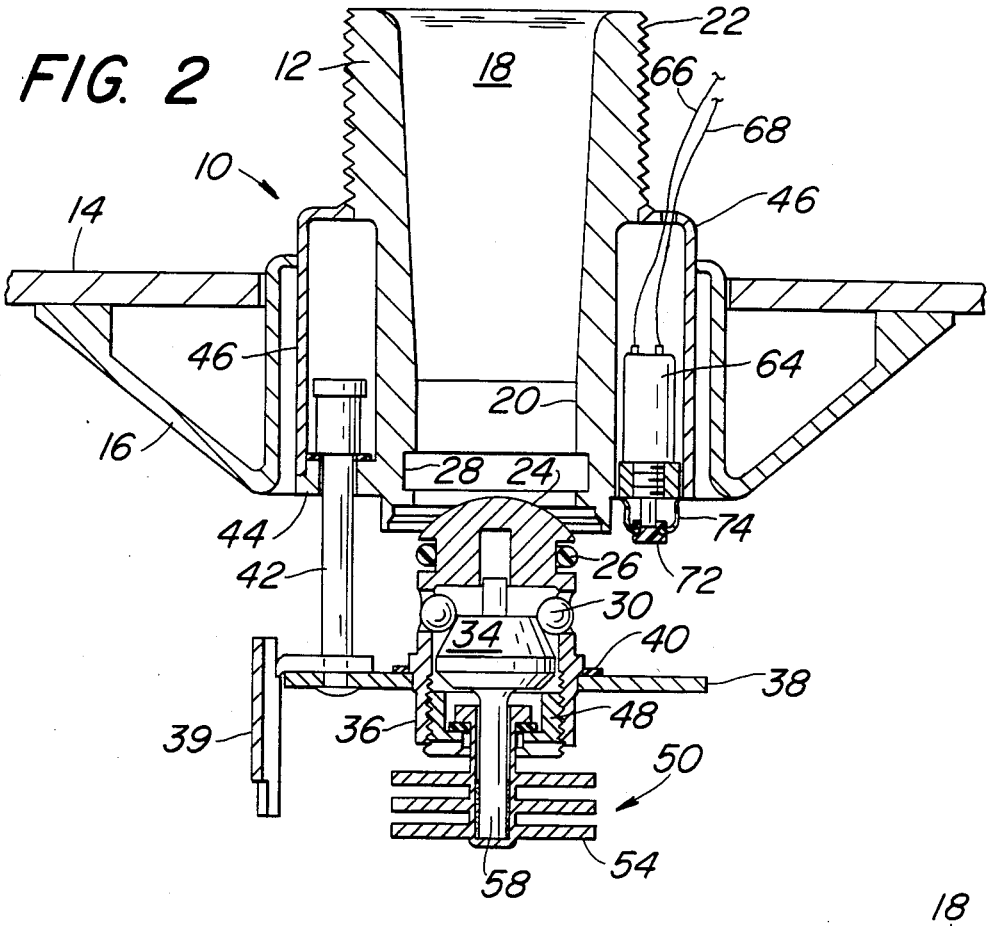
FIG. 2 is a view similar to FIG. 1 but showing the valve member in an open position.
Figure 3:
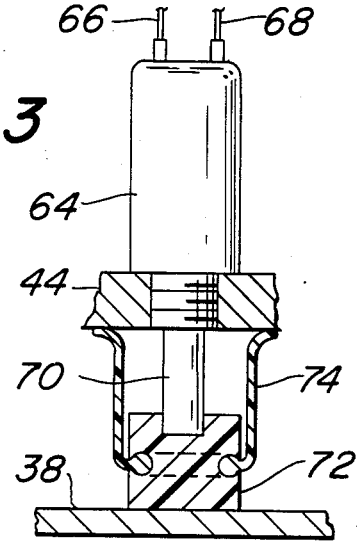
FIG. 3 is an enlarged detailed view of the electrical sensor.

Referring to the drawings in detail, wherein like numerals indicate like elements, there is shown in FIG. 1 a sprinkler head in accordance with the present invention designated generally as 10. The sprinkler head 10 may be mounted on a wall or a ceiling. For purposes of illustration, a wall mounted head is illustrated in the drawings. The sprinkler head 10 includes a body 12 shown mounted in a hole in wall 14 with a tapered escutcheon 16 overlying the portion of the wall 14 adjacent the hole therein. The upper end of wall 14 is at the left end of FIG. 1.

The housing 12 at its inlet end is provided with a tapered flow passage 18 which merges into a straight flow passage 20. Threads 22 are provided on the outer periphery of the inlet end of the housing 12 to facilitate coupling to a water supply pipe not shown. Within the straight portion 20 of the flow passage, there is provided a valve member 24 which closes the flow passage.

The valve member 24 is cylindrical and has an O-ring seal 26 on its outer periphery. The straight portion 20 and the flow passage are provided with a groove 28. Groove 28 is part of a latch means for retaining the valve member 24 in its closed position as shown in FIG. 1. The latch means includes a plurality of balls 30 which are partially disposed on the valve member 24 and partially disposed in the groove 28. The balls 30 are prevented from moving radially inwardly by a cam surface 34 on a plunger 32. As shown in the drawings, plunger 32 is disposed within a hollow cylindrical portion 36 on the valve member 24.

A deflector plate 38 is fixedly attached to the outer periphery of cylindrical portion 36 in any convenient manner. A top hat 39 is attached to plate 38 for deflecting water spray downwardly. If the head 10 is mounted on a ceiling, top hat 39 is eliminated. A seal 40 is provided between body 12 and plate 38 to protect the valve member 24 from dust and corrosive atmosphere. A plurality of guide pins 42 have their lower end fixedly secured to the deflection plate 38. Only one guide pin 42 is shown in the drawings. The pin 42 shown in FIG. 1 is used to couple a flange on top hat 39 to plate 38. Each guide pin 42 extends through a hole in flange 44 which extends radially outwardly from the lower end of the housing 12. An annular shield 46 is provided on the flange 44 of housing 12 to prevent damage to the pins 42 and other structure as will be made clear hereinafter.

A bushing 48 has threads on its outer periphery mating with threads on the inner periphery of cylindrical portion 36. Bushing 48 has a central hole. A temperature responsive means 50 is provided for releasing the latch means when it senses a predetermined temperature.

The temperature responsive means 50 may assume a variety of forms and as illustrated includes a cylinder 52 having a plurality of radially outwardly extending sensing fins 54. A pellet 56 of a fusable alloy is provided within the lower end of the cylinder 52. The plunger 32 has a stem 58 which overlies the pellet 56 with a bearing pad made from a poor heat conductor therebetween. Cylinder 52 has a flange 60 which is supported by the bottom wall of the bushing 48 with a seal 62 therebetween. The seal 62 is made from a poor heat conductor such as plastic or rubber. Cylinder 52 and its fins 54 are made from a metal which is good heat conductor.

A sensor 64 is provided sensing a predetermined amount of movement of the valve member 24 towards its open position and for providing an electrical signal indicative of such movement. The sensor 64 is preferably an electrical switch having conductors 66, 68 connected to one end thereof. The conductors extend through a hole in the shield 46 behind the wall 14. The sensor 64 is secured to the housing such as by threads thereon meshed with threads in a hole on flange 44.

The electrical sensor 64 has an actuator 70 coaxial therewith. The actuator 70 is fixedly secured at its lower end to a plastic button 72 of larger transverse dimensions. An elastomer boot 74 is provided between flange 44 and the button 72. The lower end of boot 74 has a bead embedded within the button 72. The boot 74 is of sufficient length so that its upper end will be flexed and at all times remain in contact with the flange 44.

The sensor 64 is preferably epoxy potted with a compound which serves to insulate the conductor 66, 68 at the point where they are coupled to switch terminals on the sensor 64 and thereby provide a strain relief. The boot 74 and its plastic button 72 protects the actuator 70 from dust, corrosive atmospheres, and elevated temperatures to which the deflector plate 38 is subjected to. Further, the button 72 provides a stable contact with the plate 38.

As shown in FIG. 5 electrical sensor 64 has conductor 66 coupled to a source of electrical potential 76. The conductor 68 is coupled to any one or all of a plurality of devices including any local or remote fire station 78, auxiliary equipment 80, solenoid 82, or panel display 84. The auxiliary equipment may include shutting down air circulation systems, activating automatic door closures, operating solenoid 82 to open a valve in a dry system which does not contain pressurized air, etc. Present systems commonly use compressed air in a dry system which must be bleed off when a sprinkler operates and upsets the differential which holds a dry pipe valve closed. The bleed off delays introduction of water for up to one minute and therefore is objectionable. The present invention eliminates the need for an air compressor and other devices for maintaining a dry system with pressurized air.

The panel display 84 is an electronic visual display panel at a central location with each sprinkler head 10 coupled thereto by way of a sensor 64 and conductors. When a sprinkler head is activated, a light or other device will be triggered at the panel display 84 indicating the exact location of the activated sprinkler head. The sprinkler head 10 could also be used with a preaction or deluge system.

Figure 4:
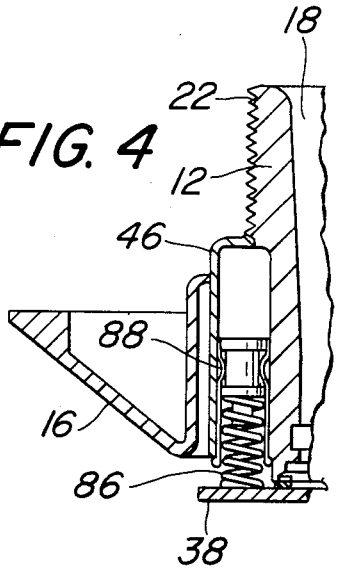
FIG. 4 is a parallel sectional view of the sprinkler head showing structure not illustrated in FIG. 1 or 2.

The sprinkler head 10 is installed as a completely assembled sprinkler. When the valve member 24 is in its closed position as shown in FIG. 1, the deflector plate 38 moves the button 72 and actuator 70 upwardly so that the sensor 64 is in an open position. The housing 12 is preferably provided with a plurality of springs 86 within a sleeve 88 radially inwardly of the shield 46. See FIG. 4. The springs 86 exert a force tending to move the valve member 24 and the deflector plate 38 to the position as shown in FIG. 2.

The sensor 64 is triggered by a predetermined amount of movement of the valve member 24 as it moves towards its open position as shown in FIG. 2. Such movement can be initiated by excessive temperature sensed by temperature responsive means 50, by tampering with the sprinkler head, or by inadvertant destruction of the sprinkler head by negligent workers.

In connection with the following description, it is assumed that the temperature sensing means 50 senses a temperature in excess of a predetermined temperature corresponding to the melting temperature of the pellet 56. When pellet 56 melts, the alloy is moved axially between the inner periphery of cylinder 52 and the outer periphery of stem 58 as the plunger 32 moves. After the plunger 32 moves a sufficient distance, the balls 30 are no longer restrained and move radially inwardly into the cylindrical portion 36. Springs 86 expand and move the valve member 24, deflector plate 38, top hat 39, and temperature sensing means 50 as a unit to the position as shown in FIG. 2. If passage 18 is filled with water under pressure, the water pressure assist the springs 86 in moving the aforesaid unit to the position as shown in FIG. 2. As the unit moves, it is guided by the pins 42. After a predetermined movement, the plastic button 72 looses contact with the deflector plate 38 whereby the switch in sensor 64 is closed.

When the switch of sensor 64 is closed, the exact location of the sprinkler head 10 is identified on the panel display 84 to provide a visual alarm, auxiliary equipment 80 is activated, and an audible alarm is generated. When water is discharged through the outlet at the end of the housing 12, it is deflected off plate 38. Any such discharge in water cannot short circuit the sensor 64 since the actuator 70 is protected by the boot 74. If desired or when there are a large number of sprinkler heads, the activating of an alarm, operating auxiliary equipment, and/or operating solenoid 82 could be affected by the panel display 84 instead of being directly coupled to the sensor 64.

The present invention may be embodied in other specific forms without departing from the spirit or essential attributes thereof and, accordingly, reference should be made to the appended claims, rather than to the foregoing specification, as indicating the scope of the invention.

I claim:

1. A sprinkler head comprising a housing having a flow passage therethrough between an inlet and an outlet, a valve member closing said outlet, said valve member being supported by said housing and being movable to an open position, means for retaining the valve member in a closed position, a temperature responsive means for releasing said retaining means at a predetermined temperature so that the valve member may move to an open position, switch means on said housing for providing an electrical signal when said valve member has moved from its closed position towards its open position, an alarm responsive to said signal, and housing means for protecting said switch means from contact with a fire quenching liquid discharged from said outlet, said switch means including an actuator connected to a contact member of dielectric material, said housing means including a protective sleeve for said actuator, said sleeve surrounding said actuator and being connected to one end of said contact member, said contact member being in contact with an element attached to the valve member when the valve member is in its closed position, said element cooperating with said actuator to maintain the switch means in an open position so long as the valve member is in its closed position.

2. A sprinkler head in accordance with claim 1 including spring means on said housing for biasing said valve member to an open position.

3. A sprinkler head in accordance with claim 1 wherein said element is a deflector plate for the liquid discharged from the outlet.

4. A sprinkler head comprising a housing having a flow passage therethrough, a valve member closing said passage, said valve member being supported by said housing and being movable to an open position, latch means for retaining the valve member in a closed position, a temperature responsive means for releasing said latch means at a predetermined temperature, and a sensor for sensing a predetermined amount of movement of the valve member as it moves towards its open position and for providing an electrical signal indicative of such movement, said sensor comprising an electrical switch supported by said housing, said switch having an actuator terminating at one end in a button made from a material which is a poor conductor of heat and electricity, a protective sleeve for said actuator, said sleeve surrounding said actuator and being connected at one end to said button, said button being in contact with a deflector plate attached to the valve member when the valve member is in its closed position, said deflector plate cooperating with said actuator to maintain the switch in an open position so long as the valve member is in its closed position.

* * * * *